US005556307A

United States Patent [19]

Johnston

[11] Patent Number: 5,556,307

[45] Date of Patent: Sep. 17, 1996

[54] MODULAR TELECOMMUNICATION JACK ASSEMBLY

[75] Inventor: James J. Johnston, Newington, Conn.

[73] Assignee: The Wiremold Company, West Hartford, Conn.

[21] Appl. No.: 345,994

[22] Filed: Nov. 29, 1994

[51] Int. Cl.[6] ..... H01R 23/02

[52] U.S. Cl. ..... 439/676; 439/427; 439/891

[58] Field of Search ..... 439/676, 344, 439/352, 353, 188, 395, 420, 421, 418, 410, 425, 449, 427, 391, 404, 941, 638, 413, 891

[56] References Cited

U.S. PATENT DOCUMENTS

| | | | |
|---|---|---|---|
| 4,457,570 | 7/1984 | Bogese | 339/17 |
| 4,629,274 | 12/1986 | Pollock | 439/410 |
| 4,764,125 | 8/1988 | Debortoli | 439/413 |
| 5,064,382 | 11/1991 | Minnis | 439/395 |
| 5,299,956 | 4/1994 | Brownell et al. | 439/941 |
| 5,399,107 | 3/1995 | Gentry et al. | 439/676 |
| 5,403,200 | 4/1995 | Chen | 439/676 |
| 5,496,191 | 3/1996 | Johnston | 439/404 |

*Primary Examiner*—Neil Abrams
*Assistant Examiner*—Brian J. Biggi
*Attorney, Agent, or Firm*—McCormick, Paulding & Huber

[57] ABSTRACT

A field terminable modular telecommunications jack assembly includes a modular jack containing a plurality of spring wire contact members mounted in cantilever position and configured to cooperate with an industry standard modular plug to minimize the length of circuit paths through the jack. Double ended insulation displacement connectors connected to fixed end portions of the spring wire contact members and projecting from the jack cooperate in plugging engagement with insulated solid wire conductors terminated by a field terminable coupling and compensating member which facilitates field termination of the jack. The solid wire conductors terminated by the coupling and compensating member are arranged within the compensating and coupling member to cancel signal coupling within the jack assembly. The double ended insulation displacement connectors are axially aligned with both the solid wire conductors and spring wire contact members.

31 Claims, 3 Drawing Sheets

84
86
84
71
71
78
74
71
71
C
C
76
72
19
20
J

66
C
66
62

62
63
63

60
16
44

51
60
16
16
47

MODULAR TELECOMMUNICATION JACK ASSEMBLY

BACKGROUND OF THE INVENTION

This invention relates in general to modular telecommunication connectors and deals more particularly with an improved modular jack assembly of the type having cantilever spring contacts for engagement with fixed contacts on a mating industry standard modular telecommunication plug.

In recent years, rapid advances in data processing have resulted in the production of new data processing equipment capable of operating at higher speeds than existing interconnection apparatus was designed to accommodate. At high speed data transmission rates the transmission circuit paths act as antennae to both broadcast and receive electromagnetic radiation. The resulting signal coupling or crosstalk which occurs between different pairs of wires in such a transmission system degrades the ability of the system to properly process incoming signals. Crosstalk occurs not only in the cables which carry data signals over long distances, but also within the connectors used to interconnect data processing equipment with the system network. Cables are presently available which minimize crosstalk between nearby and adjacent conductors, even when the conductors run in nearby or parallel relation to each other over long distances. Consequently, the problem of near end crosstalk control associated with the connectors within a network system is becoming increasingly significant, particularly as the rate of signal transmission increases.

Heretofore, the usual solution to the problem of controlling near end crosstalk has been to provide compensating circuits within each connector assembly. However this approach generally necessitates enlargement of the connectors and usually results in a substantial increase in connector production cost.

The high cost of installation and service to maintain a data processing system coupled with the cost incentives available to those who install and maintain their own systems has created an increasing demand for field terminable telecommunications connectors. Such field terminable connectors as heretofore available usually include an array of conventional insulation displacement contacts which, when employed in a conventional manner, occupy considerable space and present problems in attaining high density termination. Further, unless some provision for signal decoupling or crosstalk compensation is included such field terminable devices usually compound the existing problem of near end crosstalk associated with the connector termination. Where a compensating device is provided within a connector to overcome the near end crosstalk problem a circuit board is often employed which adds further to the size and cost of the connector.

Accordingly, it is the general aim of the present invention to provide an improved modular telecommunication jack compatible with existing modular plug configurations and having cantilever spring contact members which minimize the length of parallel circuit paths through the jack while providing contact performance equal to or better than that of jacks heretofore available.

It is a further aim of the invention to provide an improved field terminable modular telecommunication jack assembly adapted for high density termination and which provides for accurate field positioning of individual conductors to be terminated to thereby further control or cancel signal coupling within the jack assembly.

SUMMARY OF THE INVENTION

In accordance with the present invention an improved modular telecommunication jack assembly is provided for connection with a mating industry standard modular telecommunication plug including a plugging rear end portion carrying a plurality of fixed contacts having rearwardly and upwardly exposed contact surfaces. The jack assembly has a dielectric jack housing defining a forwardly open plug receptacle and includes a plurality of axially elongate resilient moveable spring wire contact members and mounting means for holding end portions of the contact members in fixed position to maintain the contact members in cantilever position and in parallel planes relative to each other within the plug receptacle. Each spring wire contact member has a forwardly and upwardly extending contact segment terminating at a free upper end and defining a forwardly and downwardly facing contact engaging portion for interfacing engagement with an associated fixed contact carried by the telecommunication plug. This arrangement minimizes the length of the circuit paths defined by the spring wire contact members. The jack assembly is field terminable and includes a coupling and compensating member for terminating a cable containing a plurality of twisted pairs of conductors. The coupling and compensating member provides a means for accurately positioning and holding the individual conductors to control or cancel signal coupling and further provides for direct plugging engagement of the terminated conductors with a dense array of insulation displacement type connectors mounted on the jack housing and connected directly to the spring wire contact members contained within the jack housing.

DETAILED DESCRIPTION OF PREFERRED EMBODIMENT

Figure 1:
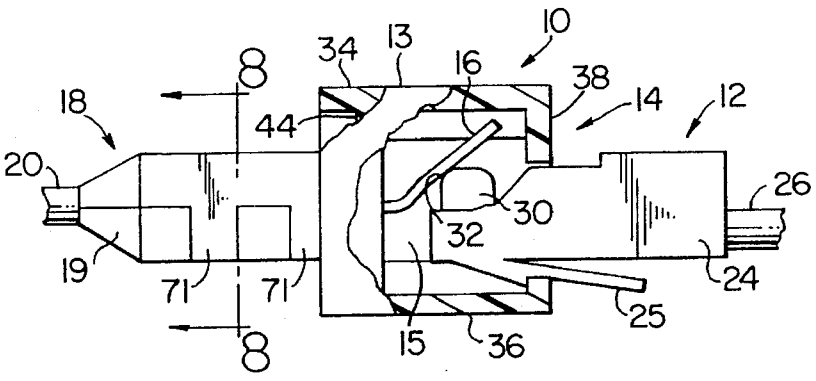
FIG. 1 is a fragmentary side elevational view of a modular telecommunication jack embodying the present invention shown with an industry standard plug connected thereto and a portion of the jack wall broken away to reveal structure therebehind.
Figure 5:
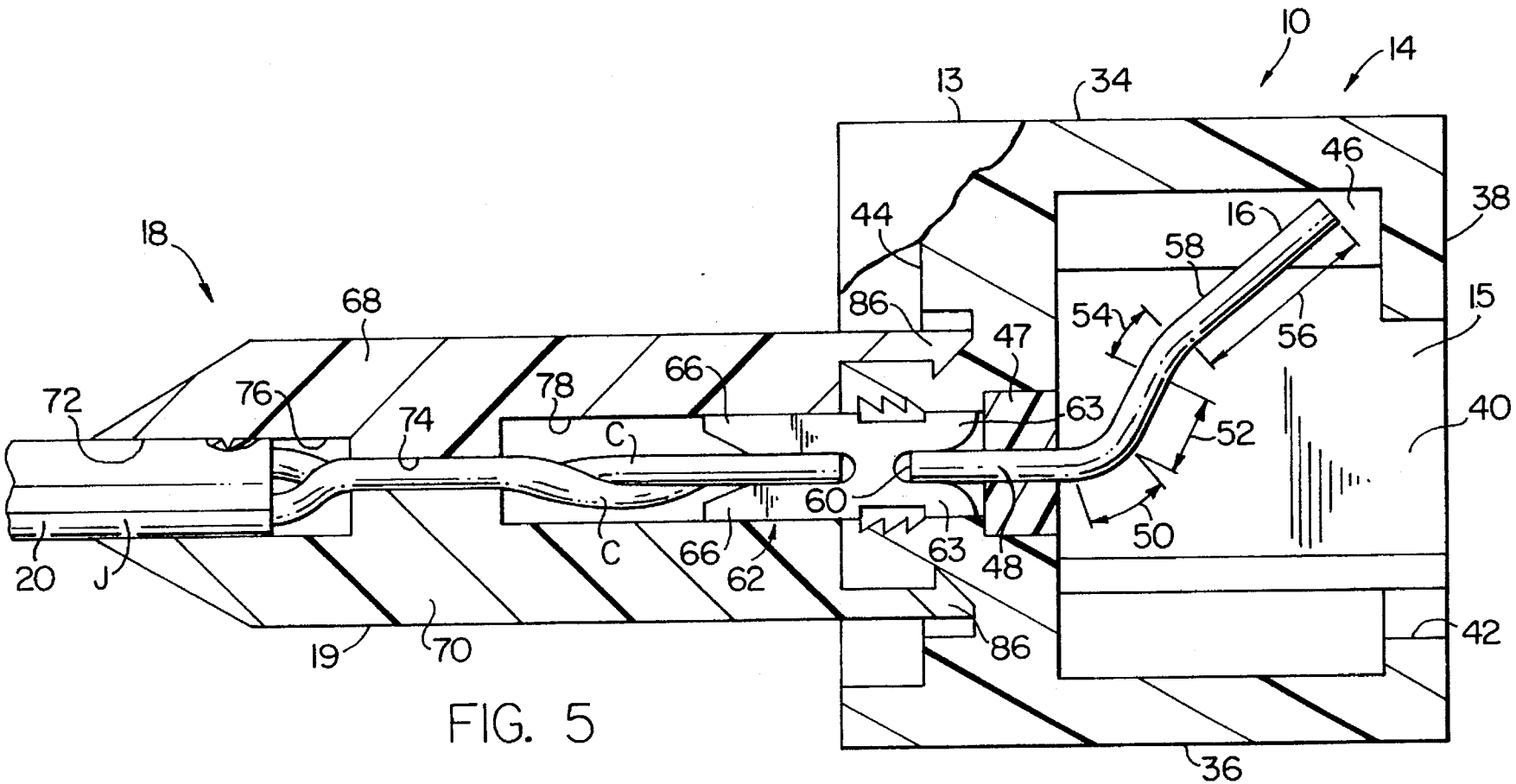
FIG. 5 is a somewhat enlarged fragmentary sectional view taken along the line 5—5 of FIG. 3.

Turning now to the drawings, a field terminable modular telecommunication jack assembly embodying the invention and indicated generally by the reference numeral 10 is shown in FIG. 1 in connected engagement with a mating industry standard modular telecommunication plug indicated generally at 12. The illustrated jack assembly 10 includes a modular jack 13 which has a jack housing designated generally by the numeral 14. The jack housing defines a plug receptacle 15 containing a plurality of spring wire contact members 16, 16 mounted in cantilever position, as shown in FIGS. 1 and 5. The contact members 16, 16 are configured to minimize the length of parallel circuit paths through the housing 14 and thereby reduce the probability of near end crosstalk occurrence within the jack 13, as hereinafter further discussed.

The jack assembly 10 further comprises a field terminable coupling and compensating assembly, indicated generally by the numeral 18 for terminating an associated line cord or electrical cable in the field and is shown attached to a typical insulated cable 20 which has an outer insulating jacket J containing a plurality of pairs of twisted, color coded, insulated solid wire conductors C, C shown in FIG. 5. The coupling and compensating assembly 18 is adapted for plugging engagement with the jack 13 to connect the conductors C, C to the contact members 16, 16 in the field and also functions as a crosstalk compensator for controlling near end crosstalk in the jack assembly 10, as will be hereinafter further discussed.

Figure 2:
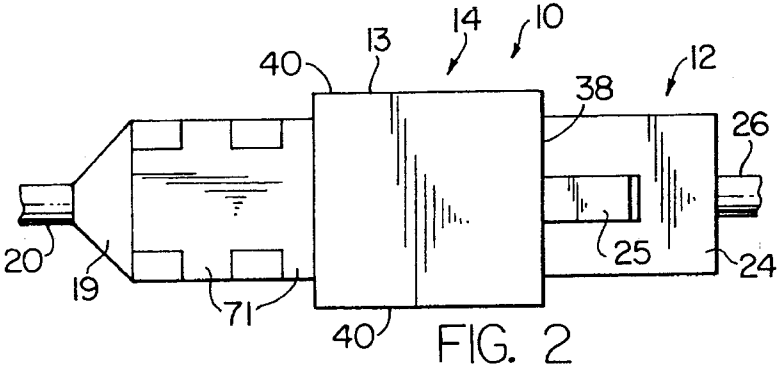
FIG. 2 is a fragmentary bottom plan view of the jack assembly and plug shown in FIG. 1.

Before considering the jack assembly 10 in further detail, the plug 12 will be briefly described to aid in better understanding the jack assembly. The illustrated plug 12 shown in FIGS. 1 and 2 comprises a standard modular telecommunication plug of the type in telephone networks and has a dielectric housing 24 which carries a latch member 25 as is well known in the art. Another line cord or electrical cable 26 is shown attached to the plug 12 and has an outer insulating jacket which contains a plurality of pairs of twisted insulated wire conductors (not shown) terminated by an in-line array of spade contacts 30, 30 (one shown in FIG. 1) mounted at the rear end of the plug housing 24. Each contact 30 is disposed within an associated slot in the plug housing 24 and has a rearwardly and upwardly facing contact surface indicated at 32 for interfacing with a contact engaging portion of an associated spring wire contact member 16, in a manner well known in the telecommunication art.

Figure 3:
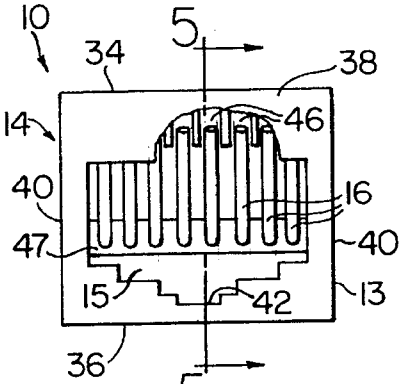
FIG. 3 is a front elevational view of the telecommunication jack assembly shown in FIGS. 1 and 2.

Considering now the jack assembly 10 in further detail and referring particularly to FIG. 5, the housing 14 is preferably molded from durable dielectric plastic material and has a generally rectangular configuration. As it appears oriented in the drawings, the housing 14 has a top wall 34, a bottom wall 36, a front wall 38, and a pair of opposing side walls 40, 40. The plug receptacle 15 opens through the front wall 38 which defines an upwardly open latch receiving opening 42, best shown in FIG. 3. A generally vertically disposed dividing wall 44 separates the front portion of the housing 14 from the rear portion and also defines the rear wall of the plug receptacle 15 as best shown in FIG. 5. A plurality of laterally spaced apart and forwardly extending slots 46, 46 at least equal in number to the wire contact members 16, 16 are formed in the top wall 34 and open downwardly into the plug receptacle 15.

Figures 9, 10, 11, 12:
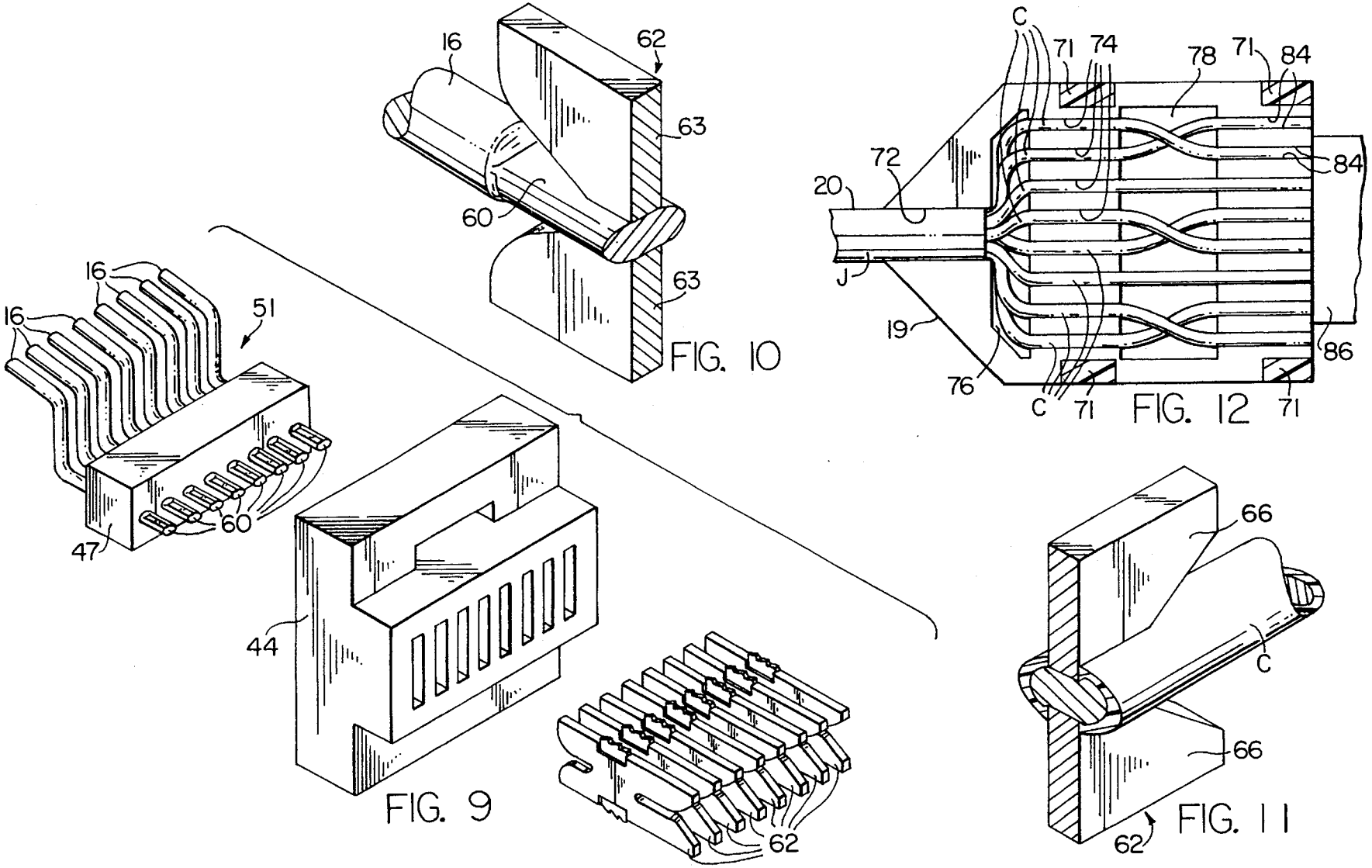
FIG. 9 is a somewhat enlarged exploded perspective view showing the spring wire contact member assembly, the dividing wall and the coaxial insulation displacement connectors which comprise the jack assembly.
FIG. 10 is a somewhat enlarged fragmentary perspective view showing a coaxial insulation displacement connector attached to the free end of a spring wire contact member.
FIG. 11 is a somewhat enlarged fragmentary perspective view showing a coaxial insulation displacement connector in plugging engagement with an insulated wire conductor.
FIG. 12 illustrates an arrangement of the insulated wire conductors within the lower section of the coupling and compensating casing.

The resilient contact members 16, 16 may vary in number and are preferably formed from axially elongate spring temper phosphor bronze round wire plated with gold or other precious metal, such as customarily used in industry standard modular telecommunication jacks. However, the illustrated jack has an in-line array of eight laterally spaced apart moveable spring wire contact members. The contact members 16, 16 may be mounted directly on the dividing wall 44, but preferably, and as best shown in FIG. 9, the contact members are mounted on a contact carrier 47 and constitute a contact assembly indicated generally at 51. The contact assembly 51 is mounted in a forwardly open complementary recess in the dividing wall 44 as shown in FIG. 5. The contact carrier 47 is preferably chemically bonded or otherwise secured to the dividing wall 44 to form an integral part of the latter wall.

A typical contact member 16, as shown in FIG. 5, has a generally horizontally disposed mounting segment 48 mounted on the contact carrier 47 which is secured in the dividing wall 44, an arcuate first connecting segment 50 extending forwardly and upwardly from the forward end of the mounting segment 48, and an intermediate segment 52 which is forwardly and upwardly inclined from the forward end of the connecting segment 50. An arcuate second connecting segment 54 extends forwardly and upwardly from the upper end of the intermediate segment 52. A contact segment 56 extends forwardly and upwardly from the upper end of the second connecting segment 54 and terminates at a free upper end within an associated one of the guide slots 46. The guide slots 46, 46 cooperate with the dividing wall 44 to retain the various contact members 16, 16 in spaced apart parallel relation to each other for flexure within parallel planes. Each contact segment 56 defines a forwardly and downwardly facing contact engaging portion 58 adapted to interface with the contact surface 32 on an associated fixed spade contact 30 carried by the plug 12 when the plug is disposed in mating engagement with the jack 13 within the plug receptacle 15, as it appears in FIG. 1.

Figure 4:
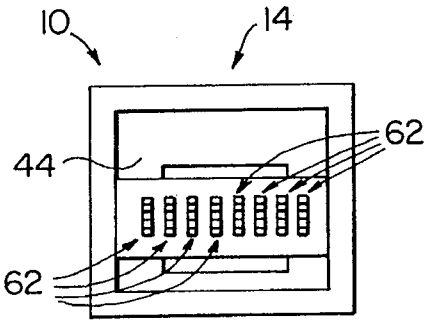
FIG. 4 is a rear view of the telecommunication jack shown in FIGS. 1 and 2.

Each contact member 16 has a bare rear end portion 60 (FIG. 5) which extends rearwardly from the contact carrier 47 into and generally terminates within the dividing wall 44. A parallel array of double ended insulation displacement connectors indicated generally at 62, 62, equal in number to said contact members 16, 16, are anchored in fixed position within the dividing wall 44 and terminate the contact members 16, 16. Each connector 62 has a pair of opposing forwardly extending legs 63, 63 which extend in parallel relation to the axis of an associated mounting segments 48. Each pair of legs 63, 63 grippingly engage an associated mounting segment bare end portion 60 therebetween and within the dividing wall 44. The upper and lower surfaces of each bare end portion 60 are preferably preformed or slightly flattened to increase the area of contact between the end portion 60 and the legs 63, 63 of an associated connector 62, as best shown in FIG. 10. Each connector 62 has a pair of opposing arms 66, 66 which extend rearwardly from and for some distance beyond the rear surface of the dividing wall 44. The connectors 62, 62 are vertically disposed in parallel planes, as best shown in FIG. 4 and cooperate with the coupling and compensating assembly 18 to facilitate field termination of the modular jack 13, as hereinafter more fully discussed.

Figure 8:
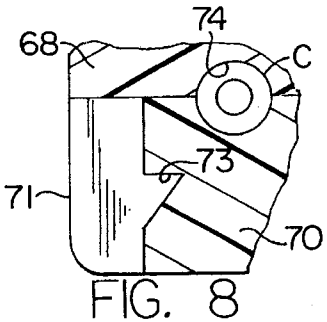
FIG. 8 is a somewhat enlarged fragmentary sectional view taken along the lines 8—8 of FIG. 1.

The coupling and compensating assembly 18 has a casing 19 preferably molded from a durable resilient dielectric plastic material and which includes upper and lower sections 68 and 70 adapted for snap-together assembly in the field. Specifically, the upper section 68 carries a plurality of resilient depending latch members 71, 71 (one shown in FIG. 8). Each latch member 71 snaps into an associated complementary latch receiving recess in the lower section. 70 when the two sections are moved into assembly with each other. Referring now particularly to FIG. 5, the upper and lower sections 68 and 70 cooperate in assembly to define a generally cylindrical opening 72 in the rear of the casing 19 sized to receive the outer insulating jacket J on the cable 20. One or more sharp projections on the casing 19 extend into the cylindrical opening 72 and incise and grip the outer insulation jacket J to provide strain relief for the cable 20. One such projection is shown in FIG. 5. The upper and low sections 68 and 70 also cooperate in assembly to define a plurality of parallel generally cylindrical channels 74, 74 of predetermined length, at least equal in number to the number of insulated electrical conductors C, C which comprise the cable 20. Each channel 74 is sized to receive and substantially complement an associated portion of an insulated electrical conductor C.

Further referring to FIG. 5, the upper and lower casing sections 68 and 70 further cooperate in assembly to define a cavity 76 within the casing 19 between the cylindrical opening 72 and the channels 74, 74 and communicating with both the latter cylindrical opening and the channels 74, 74. A cross-over recess indicated at 78 is defined by the assembled casing sections 68 and 70 forward of and in communication with the channels 74, 74, for a purpose which will be hereinafter further evident.

Figure 7:
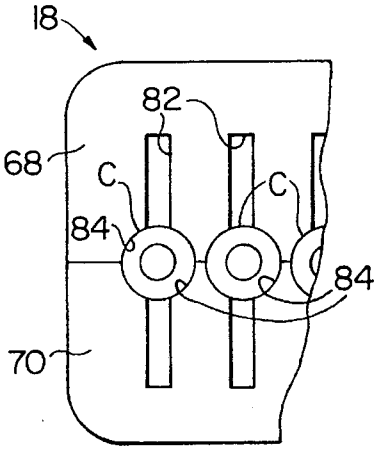
FIG. 7 is a somewhat enlarged fragmentary view similar to FIG. 6.
Figure 6:
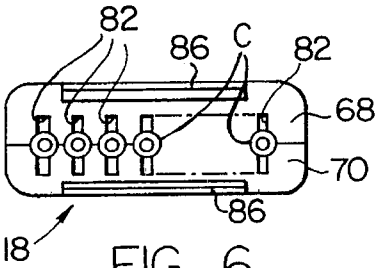
FIG. 6 is a front view of the coupling and compensating assembly shown in FIGS. 1 and 2.

The upper and lower casing sections 68 and 70 also cooperate in assembly to define an in-line array of parallel vertically disposed slots 82, 82 (FIGS. 6 and 7) which communicate with the cross-over recess 78 and open through the front face of the coupling member 19. The upper and lower portions of the slots 82, 82 are sized and shaped to receive and substantially complement the rearwardly projecting arms 66, 66 on the insulation displacement connectors 62, 62 carried by the modular jack 13. The central portion of each slot 82 is further defined by a pair of opposing shallow arcuate recesses 84, 84 sized to receive, firmly grip and hold opposite sides of an associated insulated conductor C, as best shown in FIG. 7.

Preparatory to terminating the cable 20 in the field by attaching a jack 13 thereto, the outer insulation jacket J is stripped from an end portion of the cable 20 to expose free end portions of the twisted pairs of insulated electrical conductors C, C, contained therein. The exposed free end portions of each pair of insulated conductors are then untwisted, straightened and arranged in extending parallel relation to each other. The cable 20 is then positioned in the casing lower section 70 with the end portion of the outer insulation jacket J disposed within the lower half of the cylindrical recess 72 defined by the lower section and the straightened portions of the conductors C, C are positioned within the semi-cylindrical portions of the channels 74, 74 defined by the lower section. Adjacent pairs of conductors C, C are arranged in cross-over relationship to each other within the lower portion of the cross-over recess 78 defined by the lower section to reverse polarity, all with due regard for the conductor arrangement required to assure proper tip and ring network access. A typical arrangement of the conductors C, C within the casing lower section 70 is illustrated in FIG. 12.

After the cable 20 and the conductors C, C have been arranged within the casing lower section 70 in the manner aforedescribed, the casing upper section 68 is moved downwardly into engagement with the casing lower section 70 and snapped into assembly by engaging the latches 71, 71 on the casing upper section within the latch receiving recesses 73, 73 in the casing lower section, thereby trapping a free end of each conductor C centrally within an associated slot 82. After the casing 19 has been assembled, the extending end portions of the conductors, C, C are sheared or trimmed flush with the forward face of the casing 19 to complete the coupling and compensating assembly 18.

Complete field termination of the cable 20 is achieved by moving the jack 13 into plugging engagement with the coupling and compensating assembly 18. When the insulation displacement connectors 62, 62 are plugged into the slots 82, 82 each pair of axially extending resilient arms 66, 66 displace insulation on the end portion of an associated conductor C and coaxially engage and incise the soft wire conductor end portion as shown in FIG. 11. Resilient latches 86, 86, such as shown in FIG. 5, may be provided on the casing 19 for engagement within complementary latch receiving recesses in the jack housing 14 to retain the coupling and compensating assembly 18 in assembled relation with the jack 13. In the drawings, the latches 86, 86 are shown engaged within blind recesses in the housing 14 and are not intended to be releasable. However, if a repairable jack assembly is desired provision may be made for access to the secured latches 86, 86, so that the latches may be released to free the jack 13 from the coupling and compensating assembly 18.

As previously noted, the channels 74, 74 are of predetermined length. It will now be apparent that the length of the channels 74, 74 and the length of the parallel conductor portions associated therewith are selected to attain capacitive balance within the jack assembly 10 with respect to the relatively short parallel circuit paths provided by the connectors 62, 62 and the associated spring wire contact members 16, 16 which connect between the conductors C, C and the spade contacts 32, 32 on the plug 12.

Near end crosstalk reduction within the jack 13 is achieved by minimizing the length of the cantilever beams or spring wire contact members 16, 16 required to establish electrical connection with the modular plug 12. Near end crosstalk reduction is further attained by utilizing the conductors C, C which comprises the terminated cable 20 to attain capacitive balance within the jack assembly 10.

I claim:

1. A modular telecommunication jack assembly for mating connected engagement with a modular telecommunication plug having a plugging rear end portion carrying a plurality of fixed contacts, each of said fixed contacts having rearwardly and upwardly exposed contact surface, said modular telecommunication jack comprising a jack housing defining a plug receptacle opening outwardly through the front end of said housing a plurality of substantially identical axially elongate resilient spring wire contact members, and mounting means for supporting said contact members in cantilever positions and in parallel planes within said plug receptacle, each of said contact members having a plurality of integrally connected segments including a mounting segment secured to said mounting means and a forwardly and upwardly extending contact segment terminating at a free upper end and defining a forwardly and downwardly facing contact engaging portion for engaging the contact surface on an associated one of the fixed contacts when the plug is in mating connected engagement with said jack, each of said spring wire contact members having another end, said jack assembly including a plurality of axially elongate solid wire conductors having terminal ends, and coupling means for connecting each of said conductors to an associated one of said contact members and including a plurality of double ended insulation displacement type connectors equal in number to said contact members, each of said connectors having a pair of opposing legs at one end grippingly engaging opposite sides of an associated said another end and extending in an axial direction relative to said associated another end and a pair of opposing arms at its opposite end, each of said terminal ends disposed between and grippingly engaged by an associated said pair of opposing arms.

2. A modular telecommunication jack assembly as set forth in claim 1 wherein each of said contact members has an intermediate segment disposed between said contact segment and said mounting means and said contact segment is forwardly and upwardly inclined relative to said intermediate segment.

3. A modular telecommunication jack assembly as set forth in claim 2 wherein said intermediate segment is forwardly and upwardly inclined.

4. A modular telecommunication jack assembly as set forth in claim 3 wherein each of said contact members has a first arcuate segment disposed between said intermediate segment and said mounting means.

5. A modular telecommunication jack assembly as set forth in claim 4 wherein each of said contact members has a second arcuate segment disposed between said intermediate segment and said contact segment.

6. A modular telecommunication jack assembly as set forth in claim 1 wherein each of said contact members has an arcuate segment disposed between said contact segment and said mounting means.

7. A modular telecommunication jack assembly as set forth in claim 6 wherein each of said contact members has a substantially uniform cross section throughout its length and said arcuate segment has a radius of curvature greater than the minor transverse dimension of said cross section.

8. A modular telecommunication jack assembly as set forth in claim 7 wherein said cross section is circular and said radius of curvature is greater than the diameter of said cross section.

9. A modular telecommunication jack assembly as set forth in claim 1 including retaining means cooperating with said mounting means for maintaining said contact members in said parallel planes.

10. A modular telecommunication jack assembly as set forth in claim 9 wherein retaining means comprises a plurality of spaced apart parallel guide slots formed in an upper wall of said housing and opening downwardly into said plug receptacle and said free upper end of each of said contact members is received within an associated one of said guide slots.

11. A modular telecommunication jack as set forth in claim 1 wherein said associated pair of said opposing arms extend in an axial direction relative to said terminal ends.

12. A modular telecommunication jack assembly comprising a jack housing defining an outwardly open plug receptacle, a plurality of resilient axially elongate spring wire contact members, mounting means for supporting said contact members within said plug receptacle in cantilever position and in parallel planes, said contact members having an axially extending fixed end portions, a plurality of axially elongate solid wire conductors having terminal ends, and plugging means for simultaneously electrically connecting said terminal ends to associated ones of said fixed end portions and comprising a plurality of resilient double ended insulation displacement type connectors equal in number to said contact members, each of said connectors having a pair of opposing legs at one of its ends engaging and gripping opposite sides of an associated one of said fixed end portions and extending in an axial direction relative to the axis of said associated one of said fixed end portions, each of said connectors having a pair of opposing arms at the other of its ends for engaging and gripping opposite sides of the terminal end of an associated one of said conductors.

13. A telecommunication jack assembly as set forth in claim 12 wherein said opposing arms extend in an axial direction relative to said terminal end of said associated one of said conductors.

14. A modular telecommunication jack assembly as set forth in claim 13 wherein said plugging means includes means for supporting said terminal ends and comprising a casing gripping and holding opposing portions of said terminal ends and having opposing outwardly open slots at opposite sides of each of said terminal ends for receiving and substantially complementing said opposing arms of an associated one of said connectors.

15. A modular telecommunication jack assembly as set forth in claim 14 wherein said conductors comprise at least one twisted pair of conductors and said assembly includes compensating means within said casing for controlling crosstalk within said jack and including means for maintaining axially extending segments of said conductors in generally parallel side-by-side relation to each other.

16. A modular telecommunication jack assembly as set forth in claim 15 wherein said means for maintaining said axially extending segments comprises a plurality of parallel channels defined by said casing and receiving said axially extending segments therein.

17. A modular telecommunication jack assembly as set forth in claim 14 wherein said compensating means includes crossover accommodating means within said casing for facilitating crossover of portions of said conductors located between said means for maintaining said axially extending segments and said terminal ends.

18. A modular telecommunication jack assembly as set forth in claim 17 wherein said crossover accommodating means comprises a recess within said casing.

19. A modular telecommunication jack as set forth in claim 14 wherein said casing comprises a plurality of casing sections and means for joining said casing sections in snap-together assembly with each other.

20. A modular telecommunication jack assembly as set forth in claim 12 wherein said plug receptacle opens forwardly and each of contact members has a supporting segment engaging said mounting means, an arcuate first transitional segment having a rear end integrally connected to a forward end of said supporting segment, an upwardly and forwardly inclined rectilinear intermediate segment having a rear end integrally connected to a forward end of said first transitional segment, an arcuate second transitional segment having a rear end integrally connected to a forward end of said intermediate segment, and a rectilinear contact segment having a rear end integrally connected to a forward end of said second transitional segment and forwardly and upwardly inclined relative to said intermediate segment, said contact segment terminated at a free upper end and defining a forwardly and downwardly facing contact surface.

21. A modular connector assembly comprising a housing, a plurality of axially elongate wire contact members supported by said housing and having an in-line array of fixed end portions, a plurality of axially elongate solid wire conductors having terminal ends, and means for electrically connecting each one of said conductors to an associated one of said contact members and comprising a plurality of resilient double ended insulation displacement type connectors equal in number to said conductors, each of said connectors having a pair of opposing legs engaging and gripping opposite sides of the fixed end portion of an associated one of said contact members and extending in an axial direction relative to said fixed end portion, each of said connectors having a pair of opposing arms at its other end engaging and gripping opposite sides of the terminal end of an associated one of said conductors.

22. A modular connector assembly as set forth in claim 21 wherein said opposing arms extend in an axial direction relative to said terminal end of said associated one of said conductors.

23. A modular connector assembly as set forth in claim 22 wherein said assembly includes means for supporting said terminal end of each of said conductors and comprising a casing gripping and holding opposing portions said terminal end and having opposing outwardly open slots at opposite sides of said terminal ends for receiving and substantially complementing said opposing arms of an associated one of said connectors.

24. A modular connector assembly as set forth in claim 22 wherein said casing is adapted for plugging engagement with said housing with said arms received within said slots.

25. A modular connector assembly comprising a housing, a plurality of axially elongate wire contact members supported by said housing and having fixed end portions, a plurality of axially elongate solid wire conductors having terminal ends, and means for electrically connecting each one of said conductors to an associated one of said contact members and comprising a plurality of resilient insulation displacement type connectors, each of said connectors having connecting means for electrical connection to the fixed end portion of an associated one of said contact members, each of said connectors having a pair of opposing arms for engaging and gripping opposite sides of the terminal end of an associated one of said conductors and extending in an axial direction relative to said terminal end of said associated one of said conductors when said arms are in gripping engagement with said terminal end of said associated one of said conductors.

26. A modular connector assembly as set forth in claim 25 wherein said connecting means comprises a pair of opposing legs on each of said connectors engaging and gripping opposite sides of the fixed end portions of an associated one of said contact members and extending in an axial direction relative to said fixed end portion.

27. A modular connector assembly as set forth in claim 25 wherein said assembly has means for supporting said terminal end of each of said conductors and comprising a casing gripping and holding opposing portions said terminal ends and having opposing outwardly open slots containing said terminal ends for receiving and substantially complementing said opposing arms of said connectors.

28. A modular connector assembly as set forth in claim 27 wherein said casing is adapted for plugging engagement with said housing with said arms received within said slots.

29. A modular connector assembly as set forth in claim 27 wherein said connector assembly is further characterized as a telecommunication jack assembly and said assembly including compensating means disposed within said casing for controlling crosstalk within said jack assembly.

30. A modular connector assembly as set forth in claim 25 wherein said connector assembly comprises a telecommunication jack assembly for mating connecting engagement with a modular telecommunication plug having a plugging rear end portion carrying a plurality of fixed contacts having rearwardly and upwardly exposed contact surfaces, said housing defining a plug receptacle opening outwardly through the front end of said housing, said spring wire contact members being supported in cantilever position and in parallel planes within said plug receptacle, each of contact members having a plurality of integrally connected segments including a supporting segment engaging said housing, an arcuate first transitional segment having a rear end integrally connected to a forward end of said supporting segment, an upwardly and forwardly inclined rectilinear intermediate segment having a rear end integrally connected to a forward end of said first transitional segment, an arcuate second transitional segment having a rear end integrally connected to a forward end of said intermediate segment, and a rectilinear contact segment having a rear end integrally connected to a forward end of said second transitional segment and forwardly and upwardly inclined relative to said intermediate segment, said contact segment terminating at a free upper end and defining a forwardly and downwardly facing contact engaging portion.

31. A field terminable modular telecommunication jack assembly comprising a modular jack having a jack housing defining a plug receptacle, a plurality of spring wire contact members mounted in cantilever position on said jack housing and extending into said jack plug, said spring wire contact members having fixed end portions and moveable end portions, a plurality of resilient insulation displacement type connectors equal in number to said contact members, means for electrically connecting each of said connectors to the end portion of an associated one of said contact members, each of said connectors having a pair of opposing arms projecting from said jack housing, and a coupling assembly for plugging engagement with said modular jack and having a casing defining a plurality of slots for receiving said arms when said coupling assembly is in plugging engagement with said modular jack, said coupling assembly including a plurality of axially elongated insulated solid wire conductors each of said conductors having an axially extending terminal end portion disposed within an associated one of said slots, said arms grippingly engaging said conductors within said slots when said coupling member is in plugging engagement with said modular jack, each of said terminal ends being disposed between and grippingly engaged by an associated pair of said opposing arms, each pair of opposing arms extending in an axial direction relative to an axially associated extending terminal end portion of a conductor gripped therebetween.

* * * * *